United States Patent [19]

Morgenrath

[11] Patent Number: 4,690,476

[45] Date of Patent: Sep. 1, 1987

[54] ELECTRICAL CONNECTOR SECURING SYSTEM

[76] Inventor: Jali Morgenrath, Pfeiffer Ridge, Big Sur, Calif. 93920

[21] Appl. No.: 924,986

[22] Filed: Oct. 30, 1986

[51] Int. Cl.[4] ..... H01R 13/631

[52] U.S. Cl. ..... 439/502; 439/369

[58] Field of Search ..... 339/75 R, 75 P, 103 R, 339/28

[56] References Cited

U.S. PATENT DOCUMENTS

| | | | |
|---|---|---|---|
| 2,725,543 | 11/1955 | Tanner | 339/75 P |
| 2,728,058 | 12/1955 | Phalen | 339/75 P |
| 3,097,034 | 7/1963 | Jamrosy | 339/75 P |
| 3,163,481 | 12/1964 | Salvador | 339/75 P |
| 3,475,716 | 10/1969 | Laig | 339/75 P |
| 4,097,105 | 6/1978 | Zumwalt | 339/75 P |
| 4,343,525 | 8/1982 | Knickerbocker | 339/75 P |
| 4,463,999 | 8/1984 | Knickerbocker | 339/75 P |
| 4,514,026 | 4/1985 | Herbert | 339/75 P |
| 4,566,185 | 1/1986 | Bryan | 339/75 P |
| 4,596,430 | 6/1986 | Olson | 339/75 P |

*Primary Examiner*—John McQuade

*Attorney, Agent, or Firm*—Roylance, Abrams, Berdo & Goodman

[57] ABSTRACT

Matable electrical connectors mounted on cables are secured by first and second pairs of flexible straps. Each strap is secured at one end to one of the connectors and extends from the attached end to a free end of its connector. One pair of straps has relatively rigid rings secured at their free ends. The other pair of straps have mating fastener parts separated by a hinge section adjacent their free ends. The second straps are threaded through the rings on the other straps such that the rings lie adjacent the hinge sections. Subsequently, the second straps are folded at the hinge sections and the fastener parts attached to secure the straps. The attached ends of the straps can be secured to the cables and connectors by wire ties.

18 Claims, 5 Drawing Figures

ELECTRICAL CONNECTOR SECURING SYSTEM

FIELD OF THE INVENTION

The present invention relates to a system for securing the coupling of mating electrical connectors to prevent the connectors from being inadvertently disconnected. More particularly, the present invention relates to a coupling harness securing the attachment of electrical connectors coupling electrical extension cords, preventing inadvertent disconnection of the electrical connectors by tension forces exerted on the extension cords.

BACKGROUND OF THE INVENTION

A common problem involved in the user of a plurality of extension cords connected end to end concerns the inadvertent uncoupling of plugs from sockets. When one cord is pulled and another is held by an obstruction, the plug and socket between those two cords are separated, terminating electrical power to the tool.

Conventional arrangements for securing the coupling between the plugs and sockets of connected electrical extension cords have not been particularly successful. Such arrangements do not provide a secure enough connection and/or are unacceptably complex and expensive to manufacture and operate. Additionally, these arrangements tend to be fairly limited in the types of plugs and sockets with which they can be used. Typical examples of these conventional systems for coupling electrical plug connectors are disclosed in U.S. Pat. No. 2,725,543 to Tanner; U.S. Pat. No. 3,475,716 to Laig; U.S. Pat. No. 4,097,105 to Zumwalt; and U.S. Pat. No. 4,514,026 to Herbert.

SUMMARY OF THE INVENTION

An object of the present invention is to provide a system for coupling electrical cables which is simple and inexpensive to manufacture.

Another object of the present invention is to provide a system for coupling electrical cables which can be simply and quickly operated in the field, and provides a secure connection between the connectors of the cables.

A further object of the present invention is to provide a system for coupling electrical cables which is of rugged construction.

The foregoing objects are obtained by a system for coupling electrical cables having first and second electrical connectors with matable electrical contacts mounted on the cables to be coupled, and first and second pairs of flexible straps. The first pair of flexible straps are secured at their first ends to the first connector and extend in a direction of a free end of the first connector. Each first strap has a relatively rigid ring secured at its opposite second end. The second flexible straps are secured at their second ends to the second connector and extend in a direction of a free end of the second connector. Each second strap has mating first and second fastener parts separated by a hinge section adjacent its opposite second end.

The first and second connectors can be secured by passing each second strap through one of the rings such that the rings lie adjacent the hinge sections. The second straps are then folded at the hinge sections permitting attachment of the fastener parts of each of the second straps. This provides an infinitely adjustable and secure attachment of the electrical connectors since the arrangement permits variable tensioning of the straps which force the connectors toward each other.

The foregoing objects are also obtained by a system for coupling electrical cables comprising first and second electrical connectors with matable electrical contacts mounted on cables to be coupled, and first and second pairs of flexible straps. The first flexible straps are secured at their first ends to the first connector and extend in a direction of a free end of the first connector. The second straps are secured at their first ends to the second connector and extend in a direction of a free end of the second connector. First and second means on the second ends of the first and second straps, respectively, releasably secure each of the first straps to one of the second straps. Wire ties engage and attach the straps to the cables behind the connectors.

This arrangement provides a secure attachment of the straps to the connectors. Additionally, this mechanism can be simply and easily manufactured.

The foregoing objects are further obtained by an electrical cord comprising an electrical cable with at least two electrical conductors, first and second electrical connectors on opposite ends of the cable, and first and second pairs of flexible straps. The first pair of flexible straps are secured at their first ends to the first connector and extend in a direction of the free end of the first connector. Each first strap has a relatively rigid ring secured at its opposite second end. The second flexible straps are secured at their first ends to the second connector and extends in a direction of a free end of the second connector. Each second strap has mating first and second fastener parts separated by a hinge section adjacent its opposite second end.

In this manner, the first and second connectors can be secured to mating electrical connectors having flexible straps of the form of the second straps and the first straps, respectively.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF PREFERRED EMBODIMENT

Figure 1:
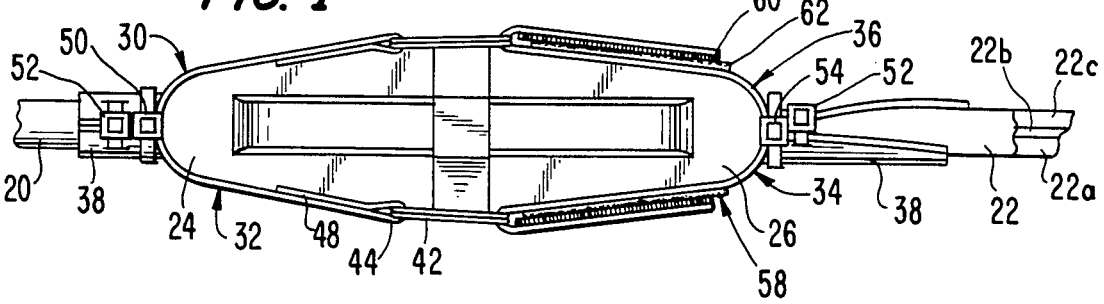
FIG. 1 is a top plan view of a system for coupling electrical cables according to the present invention in a secured position.

The present invention relates to a system for coupling electrical cables. More particularly, the present invention relates to extension cords having cables 20 and 22 which are to be connected. Cables 20 and 22 are of conventional construction and have at least two conductors, and typically have three conductors 22 a, b, and c. Cable 20 terminates in a male electrical connector or plug 24, while cable 22 terminates in a female electrical connector or socket 26.

Figure 3:
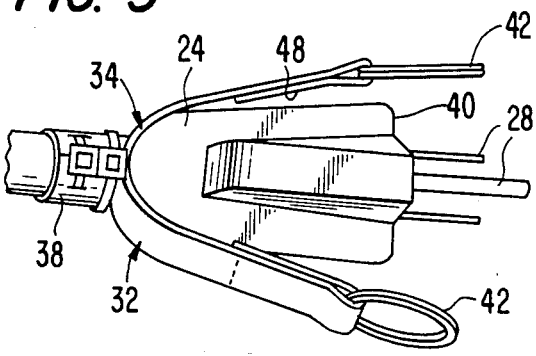
FIGS. 3 and 4 are top elevational views of separated plug and socket members, respectively, according to the present invention before being connected which may be provided on opposite ends of a single extension power cord.

Like the cable, plug 24 and socket 26 are of conventional construction. As illustrated in FIG. 3, plug 24 has a plurality of axially extending, exposed contacts 28. Plug contacts 28 are received within suitable openings in the end face of socket 26 and engage corresponding female contacts within the body of socket 26. Thus, plug 24 and socket 26 mechanically and electrically couple cables 20 and 22 in a conventional manner.

Plug 24 and socket 26 are secured in a coupled condition by a first pair of straps 30 and 32 and a second pair of straps 34 and 36. Straps 30 and 32 are identical. Straps 34 and 36 are identical. The body of the straps can be formed of any suitable flexible material that can be easily bent and tensioned, while being capable of withstanding the tension forces without undue elongation. Preferably, the straps are formed of an interwoven fabric of synthetic materials. The adjacent ends of straps 30 and 36 and the adjacent ends of straps 32 and 34 can be releasably coupled to secure the coupling of plug 24 and socket 26.

Each of the straps 30 and 32 of the first pair have one end 38 secured about cable 20 at the rear surface of plug 24. From first end 38, the first straps extend forwardly in the direction of the free end 40 of plug 24. A relatively rigid, circular ring 42 is secured at the free end 44 of each strap 30 or 32. A folded portion 48 of the strap extends through the ring from the outside of the strap and then is folded over against an inside surface of the strap. Stitching 46 secures the folded portion 48 of the strap to the remainder of the strap to secure the attachment of ring 42.

Ring 42 can be of the split ring type normally found on key rings, which rings generally constitute a helically wound piece of metal. Alternatively, a solid endless ring or a solid plastic D ring can be provided.

End 38 of each strap 30 and 32 is bent or formed into a semi-cylindrical shape against diametrically opposite sections of the cable immediately adjacent plug 24. Two wire ties 50 and 52, of conventional configuration, secure the straps in place. Wire tie 50 is closest to plug 24 and is wrapped about the exterior surfaces of both straps 30 and 32. Wire tie 52 extends through openings 54 provided in ends 38. In this manner, the wire ties constrict the straps about the cable and connect them to plug 24 such that straps 30 and 32 are permanently secured to cable 20 and plug 24. By wrapping wire tie 50 completely about the straps, the stresses created by pulling the straps outwardly are uniformly distributed about the straps to avoid tearing of the straps. Threading wire tie 52 through openings 54 provides a positive engagement of the wire tie with the strap which will prevent movement of wire tie 50 relative to straps 30 and 32 axially along the cable in a direction away from the plug. Relative axial movement in a direction toward the plug is restricted by the plug itself.

The second pair of straps 34 and 36 are secured to cable 22 and socket 26 at their attached ends 38 using ties 50 and 52 in the same manner discussed above in connection with straps 30 and 32. Second straps 30 and 34 extend from the attached ends 38 in a direction of the free end 56 of socket 26.

Each of the second straps 34 and 36 have two parts of a releasable fabric fastener 58. As more clearly illustrated in FIGS. 4 and 5, fabric fastener 58 comprises a flexible hook section 60 extending inwardly from the free end of each second strap and a fabric loop section 62 secured to each second strap between the strap free end and the attached end 38. The hook members of flexible hook section 60 are releasably engageable with the loops of loop section 62. Fastener sections 60 and 62 form a fabric fastener of the type sold under the trademark VELCRO.

Fastener sections 60 and 62 are separated by a flexible hinge section 64 of straps 34 and 36. Straps 34 and 36 are folded about an axis passing through hinge section 64 to permit each flexible hook section 60 to overlie the loop section 62 of that strap for releasable engagement of these two fastener sections.

Fastener sections 60 and 62 can be secured to the straps in any suitable manner, typically by stitching or adhesive.

Figure 2:
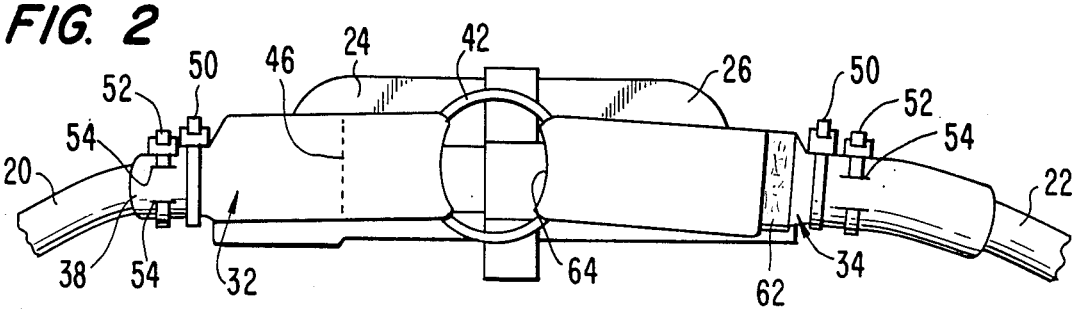
FIG. 2 is a side elevational view of the system of FIG. 1.
Figure 5:
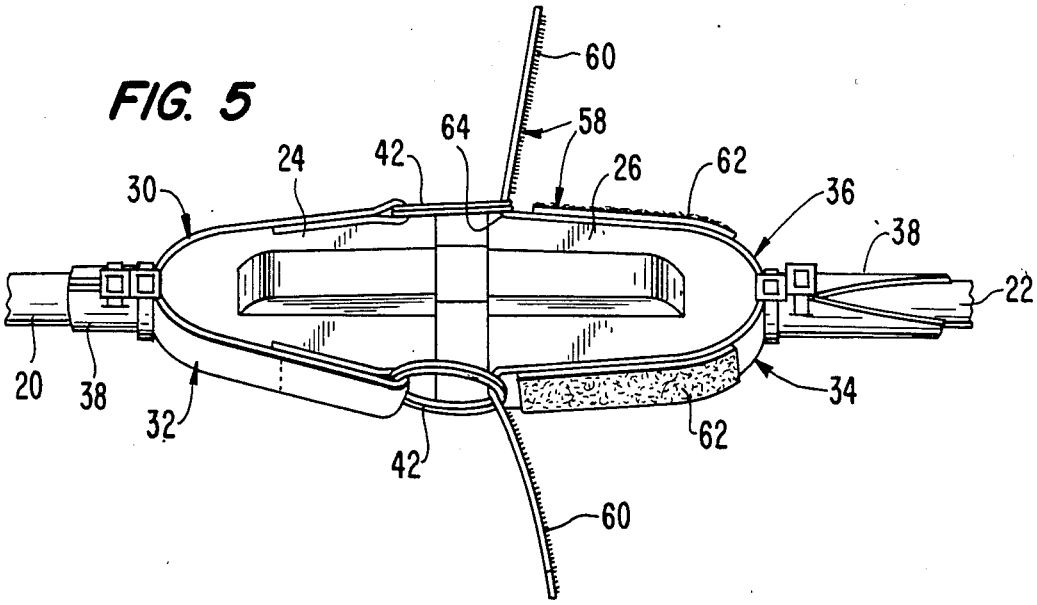
FIG. 5 is a top plan view of a system of FIG. 1 in an intermediary stage of being secure.

Cables 20 and 22 are initially mechanically and electrically connected by coupling plug 24 to socket 26. The first and second straps 30, 32, 34 and 36 are provided permanently on their respective cables and electrical connectors. The portions of straps 34 and 36 supporting flexible loop sections 60 are threaded through rings 42, as illustrated in FIG. 5. In this position, rings 42 lie adjacent hinge sections 64. Second straps 34 and 36 are then folded about hinge sections 64 with the free ends thereof being pulled rearwardly (i.e., in a direction toward cable 22), tensioning all of the straps as the flexible hook sections 60 are forced against loop sections 62 as illustrated in FIGS. 1 and 2.

Passing the second straps through the rings permits adapting the coupling system to a wide variety of different electrical connectors. Additionally, this mechanism simply provides adequate tension to the straps to maintain the connection. Since the forces exerted on flexible fabric fastener 58 are transverse to the connection between fastener sections 60 and 62, fastener sections 60 and 62 will not tend to separate when cables 20 and 22 are pulled in opposite directions.

Figure 4:
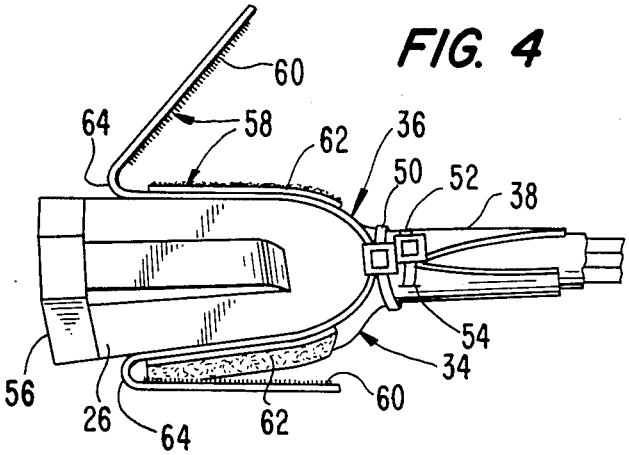

A typical use of the present invention involves an extension cord with the plug end as illustrated in FIG. 3 and the socket end as illustrated in FIG. 4. This will enable the extension cord to mate with and be secured with similarly formed extension cords as explained hereinabove. This arrangement can also be employed for securing plug 24 to a wall socket, wherein second straps 34 and 36 are secured to the wall socket in a suitable manner.

While a particular embodiment has been chosen to illustrate the invention, it will be understood by those skilled in the art that various changes and modifications can be made therein without departing from the scope of the invention as defined in the appended claims.

What is claimed is:

1. A system for coupling electrical cables, comprising:

first and second electrical connectors with matable electrical contacts mounted on the cables to be coupled;

a pair of first flexible straps secured at first ends thereof to said first connector and extending in a direction of a free end of said first connector, each of said first straps having a relatively rigid ring secured at an opposite second end thereof; and a pair of second flexible straps secured at first ends thereof to said second connector and extending in a direction of a free end of said second connector, each of said second straps having mating first and second fastener parts separated by a hinge section adjacent an opposite second end thereof;

whereby said first and second connectors can be secured passing each said second strap through one of said rings such that said rings lie adjacent said hinge sections, folding said second straps at said hinge sections, and then attaching said fastener parts of each of said second straps.

2. A system according to claim 1 wherein said first ends of said straps engage the cables adjacent said connectors, said first ends being attached to the cables behind said connectors by wire ties.

3. A system according to claim 2 wherein said wire ties extend through openings in said straps.

4. A system according to claim 1 wherein said first and second fastener parts form a releasable fabric fastener having flexible hook members and loops releasably engageable by said hook members.

5. A system according to claim 1 wherein one of said connectors is a plug; and the other of said connectors is a socket.

6. A system according to claim 1 wherein said first straps comprise folded over end sections, opposite said first ends, receiving said rings.

7. A system for coupling electrical cables, comprising:

first and second electrical connectors with matable electrical contacts mounted on the cables to be coupled;

a pair of first flexible straps secured at first ends thereof to said first connector and extending in a direction of a free end of said first connector;

a pair of second flexible straps secured at first ends thereof to said second connector and extending in a direction of a free end of said second connector;

first and second means, on opposite second ends of said first and second straps, respectively, for releasably securing each of said first straps to one of said second straps; and wire ties engaging and attaching said straps to the cables behind said connectors.

8. A system according to claim 7 wherein said straps have openings therein adjacent said first ends, said wire ties extending through said openings.

9. A system according to claim 8 wherein each pair of said straps is attached by two wire ties with one of said wire ties extending through said openings and the other of said wire ties overlying both of said straps of the respective pair.

10. A system according to claim 7 wherein one of said connectors is a plug; and the other of said connectors is a socket.

11. An electrical extension cord, comprising:

an electrical cable with at least two electrical conductors;

a first electrical connector on one end of said cable;

a second electrical connector on an opposite end of said cable;

a pair of first flexible straps secured at first ends thereof to said first connector and extending in a direction of a free end of said first connector, each of said first straps having a relatively rigid ring secured at an opposite second end thereof; and a pair of second flexible straps secured at first ends thereof to said second connector and extending in a direction of a free end of said second connector, each of said second straps having mating first and second fastener parts separated by a hinge section adjacent an opposite second end thereof;

whereby said first and second connectors can be secured to mating electrical connectors having flexible straps of the form of the second straps and the first straps, respectively.

12. An electrical extension cord according to claim 11 wherein said first ends of said straps engage the cable adjacent said connectors, said first ends being attached to the cable behind said connectors by wire ties.

13. An electrical extension cord according to claim 12 wherein said wire ties extend through openings in said straps.

14. An electrical extension cord according to claim 11 wherein said first and second fastener parts form a releasable fabric fastener with flexible hook members and loops releasably engageable by said hook members.

15. An electrical extension cord according to claim 11 wherein one of said connectors is a plug; and the other of said connectors is a socket.

16. An electrical extension cord according to claim 11 wherein said first straps comprise folded over end sections, opposite said first ends, receiving said rings.

17. An electrical extension cord according to claim 12 wherein said straps have openings therein adjacent said first ends, said wire ties extending through said openings.

18. An electrical extension cord according to claim 17 wherein each pair of said straps is attached by two wire ties with one of said wire ties extending through said openings and the other of said wire ties overlying both of said straps of the respective pair.

* * * * *